United States Patent [19]

McArthur

[11] 4,440,220

[45] Apr. 3, 1984

[54] SYSTEM FOR STABBING WELL CASING

[76] Inventor: James R. McArthur, Rte. 1, Box 50, Tishomingo, Okla. 73460

[21] Appl. No.: 385,035

[22] Filed: Jun. 4, 1982

[51] Int. Cl.[3] ..... E21B 19/00

[52] U.S. Cl. ..... 166/85; 175/85

[58] Field of Search ..... 166/85, 77.5, 335, 342; 175/85, 52, 220; 414/22; 173/164; 308/3.9; 384/217, 273, 432

[56] References Cited

U.S. PATENT DOCUMENTS

| | | | |
|---|---|---|---|
| 1,884,874 | 10/1932 | Ross | 166/77.5 |
| 2,184,051 | 12/1939 | Moise | 166/85 |
| 2,206,185 | 7/1940 | Graham et al. | 166/85 |

*Primary Examiner*—Ernest R. Purser
*Assistant Examiner*—Michael Starinsky
*Attorney, Agent, or Firm*—William R. Laney

[57] ABSTRACT

Apparatus for stabbing well casing to join casing sections to each other, including a rotary table assembly for supporting a casing section in a well bore, a derrick over the rotary table assembly, a crown block at the top of the derrick, a first piston and cylinder subassembly pivotally mounted on one side of the derrick over the rotary table assembly and below the crown block for pivotation about a horizontal axis, a second piston and cylinder subassembly pivotally mounted on a second side of the derrick for pivotation about a horizontal axis, with said second piston and cylinder subassembly located over the rotary table assembly and below the crown block and extending substantially normal to the direction of extension of the first piston and cylinder subassembly, cooperating casing clamping elements carried on the piston rods of the first and second piston and cylinder subassemblies, and counter balancing subassemblies connected to the first and second piston and cylinder subassemblies for pivoting the first and second piston and cylinder subassemblies to a vertically extending inoperative position.

13 Claims, 6 Drawing Figures

SYSTEM FOR STABBING WELL CASING

BACKGROUND OF THE INVENTION

1. Field of the Invention

This invention relates to casing stabbing apparatus employed for the purpose of mechanically engaging large diameter heavy well casing of the type used in oil and gas wells.

2. Brief Description of the Prior Art

In the production of hydrocarbons from subterranean locations, it is a prevalent practice to case the well bore, with the casing first being lowered into position in the well bore from a rig rotary table, and then cemented in position in the well bore. In deep wells of the type currently within the capability of the technology (exceeding 15,000 feet), it is often necessary to use casing having a diameter which is quite large. Sections of casing having diameters of 14 inches and above become quite heavy and pose a number of problems in handling, particularly in connecting and disconnecting the casing sections to each other, and in lowering the casing string into the well bore. The bulk and weight of the large diameter casing sections also pose severe problems of safety to rig crews installing the casing, and require the utilization of mechanical assistance wherever feasible.

Various types of mechanical arrangements have been employed for handling tubular goods utilized in oil and gas production, including drill pipe and casing. The roughnecks on the rig floor are in no case relieved of all necessity to handle the pipe, and these personnel remain subject to bruises incurred by accidental body contact with swinging pipe, and occasionally death is caused by accidental blows to the head inflicted by the heavy swinging tubular sections. In at least the case of tripping in and out of wells (the terms refer to the process of connecting and disconnecting pipe sections in running drill pipe or casing into or out of the well bore), it is necessary to manually handle the pipe for purposes of alignment as the threaded end sections of the drill pipe or casing are joined to each other.

In the joinder of casing, it is the customary practice to suspend one section of casing from the rotary table in the rig floor, with the lower end portion of the section projecting into the well bore and the threaded upper end portion exposed above the rotary table. An elongated section of casing to be connected to the section which is suspended in the well bore is picked up by the tackle carried in the mast of the derrick, and is hung from a crown block so as to be suspended vertically over the subjacent section (hanging from the rotary table) to which it is to be connected.

After the following section of casing to be joined to the section hung from the rotary table has been brought over the rotary table with the crown block, it is necessary to precisely align the threaded end section, termed the pin, with the female threaded end section (the box) of the casing section therebelow. This is accomplished by one or two roughnecks standing on the well floor and another member of the rig crew standing on a platform midway between the rig floor and the top of the derrick The man who stands on the platform must grasp the casing section and prevent it from oscillating as it is slowly lowered by the crown block to a position where the threads carried at its lower end are immediately above and ready to be threadedly joined with the female threads in the section therebelow. The man aloft on the platform helps to guide the casing section to the precise position where, as it is further lowered, the male threads will mate with the female threads of the section hung from the rotary table.

Although some systems have been provided for mechanically racking various types of drill pipe and casing as it is pulled from the well bore and racked during a trip out of the well bore, and systems also devised for aligning and connecting sections of drill pipe, the advent of drilling to depths in excess of 15,000 feet has resulted in the utilization of large diameter casing which is very heavy, and which requires very husky crewmen, particularly the person who must stand aloft on the platform and damp the oscillations of the swinging casing section, and see that it is lowered in precise alignment with the section to which it is to be joined. This process, called stabbing, is repeated many times as hundreds of sections of casing are joined to each other and lowered into the well bore. The task of casing stabbing is very fatiguing to the personnel who manually handle the heavy tubular elements, and even without the lack of alertness caused by fatigue after hours of working at these jobs, there is always danger to the personnel from severe injury resulting from being struck by the swinging casing sections.

Among mechanical systems which have previously been proposed for handling various types of tubular goods employed in the drilling of oil and gas wells, one example is to be found in the disclosure of U.S. Pat. No. 1,812,351 to Marsh. In this patent, a pipe racking device is depicted and described which utilizes a pair of angulated piston and cylinder assemblies to swing drill pipe from its position over the rotary table to the desired racked position in the corner of the derrick as the stand of pipe is unscrewed from the drill string being removed from the well. A hook and clamp assembly carried at the end of the two piston and cylinder assemblies is used for surrounding and tightly engaging the drill pipe section once it has been disconnected from the string therebelow, and the piston and cylinder subassemblies are then energized to swing the drill pipe section over to the racking position. The piston and cylinders used in this system are located relatively close to the derrick floor and are counterbalanced to extend in a horizontal position by weights acting through flexible members extended over pulleys and attached at one end to each of the piston and cylinder subassemblies.

Another mechanical device for centering casing during the drilling of oil and gas wells is that which is depicted in Russe U.S. Pat. No. 4,295,527. In the Russe patent, a pair of tongs are provided which are hydraulically converged to clamp about a casing section at one location therealong. These tongs are rigidly aligned by a mechanical connecting member with a split sleeve element joinable to the top of the section of casing therebelow into which the superjacent suspended casing section gripped by the tongs is to be stabbed. A set of conventional power tongs is then used to spin up the upper casing section so that the threads are tightly engaged and the joint made up.

Another type of pipe stabbing guide is illustrated and described in Bolpin U.S. Pat. No. 2,147,002. The entire Bolpin assembly is located relatively close to the rig floor, and is a two part device, with one part gripping the end portion of the descending casing section and the other attached to the upper end of that section of the casing string which is suspended in the rotary table. The two parts are interconnected by a vertically extending stem.

The Bolpin patent includes a good description of the difficulty posed to the drilling crew in quickly and accurately swinging the new section of casing or drill pipe into position for joinder to the drill string suspended in the well bore.

In the Bolpin stabbing guide, the element which actually guides the upper section of drill pipe is merely a finger against which this section of drill pipe is abutted or rested as it descends to the point where the male threads at the lower end thereof make contact with and engage the female threads in the box section carried on the upper end of the pipe section therebelow. No positive retentive engagement of the finger with the upper section of pipe is provided.

Other types of stabbing devices and guides are shown in Graham et al. U.S. Pat. No. 2,206,184, Calhoun U.S. Pat. No. 2,450,934, True U.S. Pat. No. 2,828,024, Scaggs U.S. Pat. No. 4,274,777, Guier U.S. Pat. No. 3,533,516 and Moise U.S. Pat. No. 2,184,051.

The Moise patent employs a pair of hydraulic piston and cylinder assemblies extended from two adjacent corners of the derrick so as to be generally at right angles to each other with the free ends of the piston rods carrying elements which can push against a well casing section to cooperatively (as between the two pushing elements) bring the casing into a vertical position in which it is aligned for stabbing into the casing section therebelow. The casing is not, however, retentively clamped or physically surrounded by the guiding structure during its use.

BRIEF DESCRIPTION OF THE PRESENT INVENTION

The present invention provides a system for mechanically handling vertically suspended casing sections so as to alleviate the necessity for drilling rig personnel to man-handle such casing sections, thereby imperiling life and limb, and causing extreme bodily fatigue and concommitant loss of efficiency.

Broadly described, the present invention comprises a pair of cooperating piston and cylinder subassemblies which extend at substantially right angles to each other, and which are disposed at locations on the drilling rig between the rig floor rotary table and the crown block by which a casing section is suspended in a vertical orientation during the making up of a string of casing for positioning in a well bore. The piston and cylinder subassemblies each have one end pivotally connected to structural elements of the derrick so that they can be pivoted about horizontal axes. Each piston and cylinder subassembly is counterbalanced to reduce the force required to move each of the subassemblies between an inoperative, vertically extending position, and a position in which the subassembly extends substantially horizontally in an operative position for purposes of engaging a casing section to be stabbed or connected to an aligned casing section therebelow.

The piston and cylinder subassemblies carry cooperating clamping elements at the free ends of the piston rods of each, and these cooperating clamping elements function to closely surround a casing section to enable the casing section to be precisely positioned by manipulation of the piston and cylinder subassemblies. The clamping elements are dimensioned to closely surround the casing section to be engaged, yet do not fit so tightly about the casing section that the casing section cannot be rotated about its axis for the purpose of threadedly coupling the casing section to an aligned section of casing which is suspended in the rotary table of the rig.

Each of the piston and cylinder subassemblies includes a spring element positioned to accommodate lateral movement of that portion of the casing section engaged by the stabbing system in those instances where a section of casing is slightly bent and departs from true axial linearity over its length.

An important object of the invention is to provide a system for mechanically aligning casing sections to be joined in a casing string being made up in an oil or gas well bore hole.

Another object of the invention is to provide a casing stabbing system which can be operated with a minimum of manual force applied to the various elements of the system in moving the system between an operative and an inoperative position.

A further object and marked advantage of the present invention is the ability of the casing stabbing system of the invention to yield to, or accommodate wobbling of, a casing section which is to be stabbed into an aligned casing section located therebelow as such upper casing section may undergo wobbling or movement at the point of engagement by the stabbing system due to warping or misalignment of the casing section over its length.

A further object of the invention is to provide a casing stabbing system which can be more easily utilized for making minute adjustments in the position of the threaded lower end of a suspended casing section during a casing stabbing operation than previously used devices of this general type.

Additional objects and advantages of the invention will become apparent as the following detailed description of the invention is read in conjunction with the accompanying drawings which illustrate a preferred embodiment of the invention.

GENERAL DESCRIPTION OF THE DRAWINGS

FIG. 1 is a schematic view illustrating the general location and relative arrangement of the casing stabbing system of the invention, an oil well derrick upon which the casing stabbing system is mounted, a suspended upper section of casing and a rotary table located at the rig floor and suspending a second section of casing below that upon which the casing stabbing system of the present invention is utilized.

DETAILED DESCRIPTION OF A PREFERRED EMBODIMENT OF THE INVENTION

Figure 1:
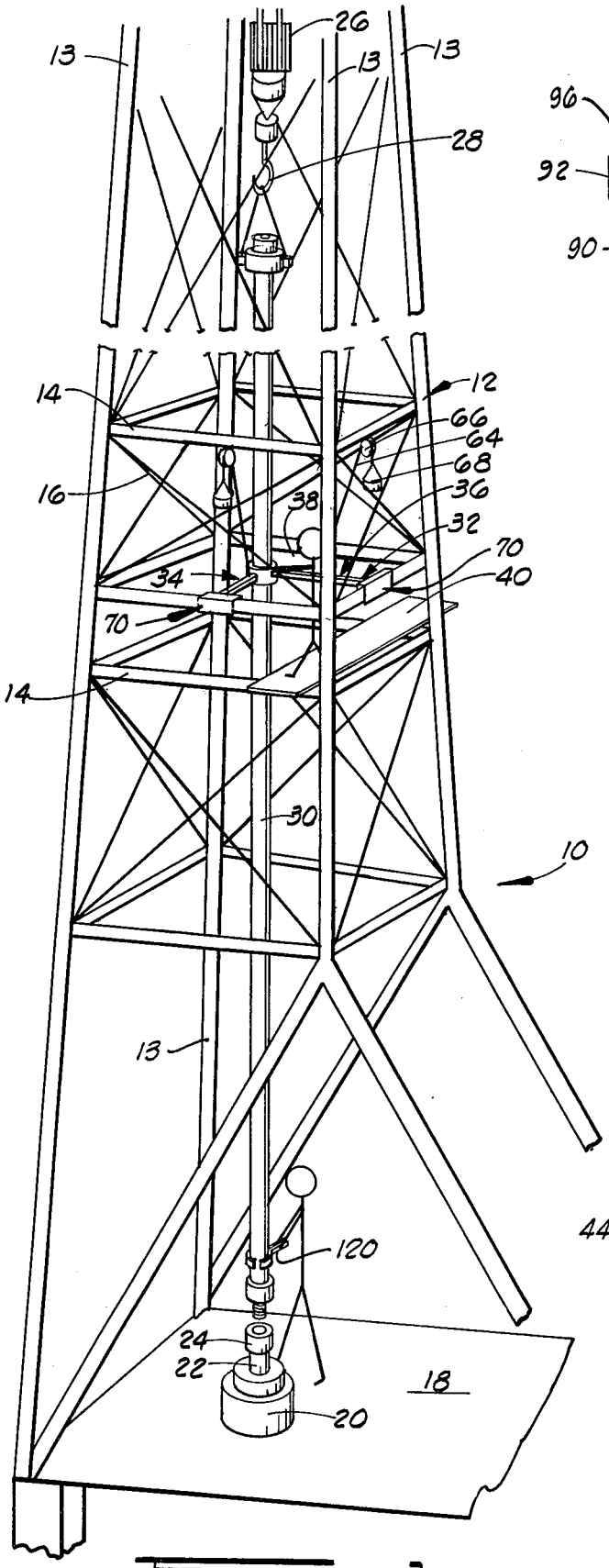

Referring initially to FIG. 1 of the drawings, an oil well drilling rig is there illustrated and is designated generally by reference numeral 10. The rig includes a vertically extending derrick or mast 12 which, in conventional construction, is generally rectangular or square in cross-sectional configuration, including a plurality of vertically extending corner beams 13 joined by a plurality of vertically spaced, horizontally extending angle iron cross braces 14. A plurality of diagonal braces or struts 16 provide further structural strength to the derrick.

The derrick or mast 12 is erected above a rig floor, designated generally by reference numeral 18, and at the rig floor, a rotary table 20 is utilized for rotating drill pipe in the drilling of a well bore, and also for suspending sections of drill string, and later, casing which is to be used to case the bore hole developed by drilling. In the use of the rotary table 20 for suspending such tubular elements, slips or equivalent devices are used to wedge the upper end of the tubing or casing section in the rotary table so that it is suspended downwardly therefrom in the well bore. In FIG. 1, a casing section 22 having an internally threaded box or collar 24 located at the upper end thereof is shown suspended in the rotary table.

For the purpose of assembling a string of casing by end-to-end joinder of casing sections, a tackle system is provided at the top of the derrick 12, and includes a crown block 26 which carries a hook 28 from which a section of casing 30 is suspended. The manner in which a section of casing is picked up from a racked location and elevated to the suspended position illustrated in FIG. 1 is well understood in the petroleum technology and will not be further detailed here.

In order to achieve proper alignment of the upper casing section 30 with the lower casing section 22 to facilitate threaded joinder of these sections to each other, and also for the purpose of damping oscillations of the suspended upper casing section, the casing stabbing system of the present invention is provided. The casing stabbing system is illustrated schematically in FIG. 1 and there denominated generally by reference numeral 32. The system includes a pair of hydraulic piston and cylinder subassemblies, designated generally by reference numerals 34 and 36. These cylinders are manipulated and are operated by one of the rig crewman 38 whose working position is on a platform 40 mounted on the derrick 12 at a location approximately midway between the rig floor 18 and the crown block 26.

Figure 4:
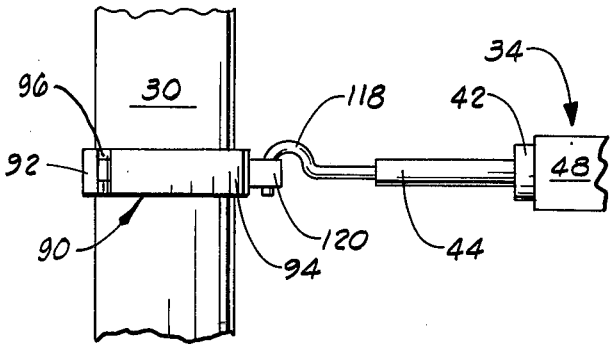
FIG. 4 is a view in elevation of a part of one of the piston and cylinder subassemblies, and of a part of the clamp subassembly included in the casing stabbing system of the present invention.
Figure 2:
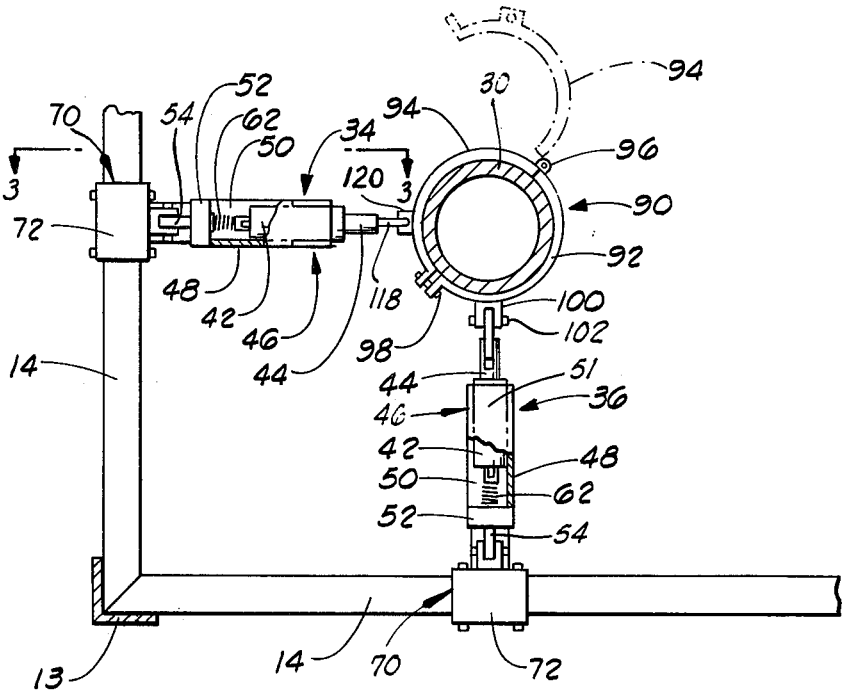
FIG. 2 is a plan view of the casing stabbing system of the invention, showing certain parts broken away for clarity of illustration, further showing, in section, casing engaged by the stabbing system, and showing, in dashed lines, one of the jaws of a clamp subassembly opened apart to its inoperative, casing receiving position.
Figure 3:
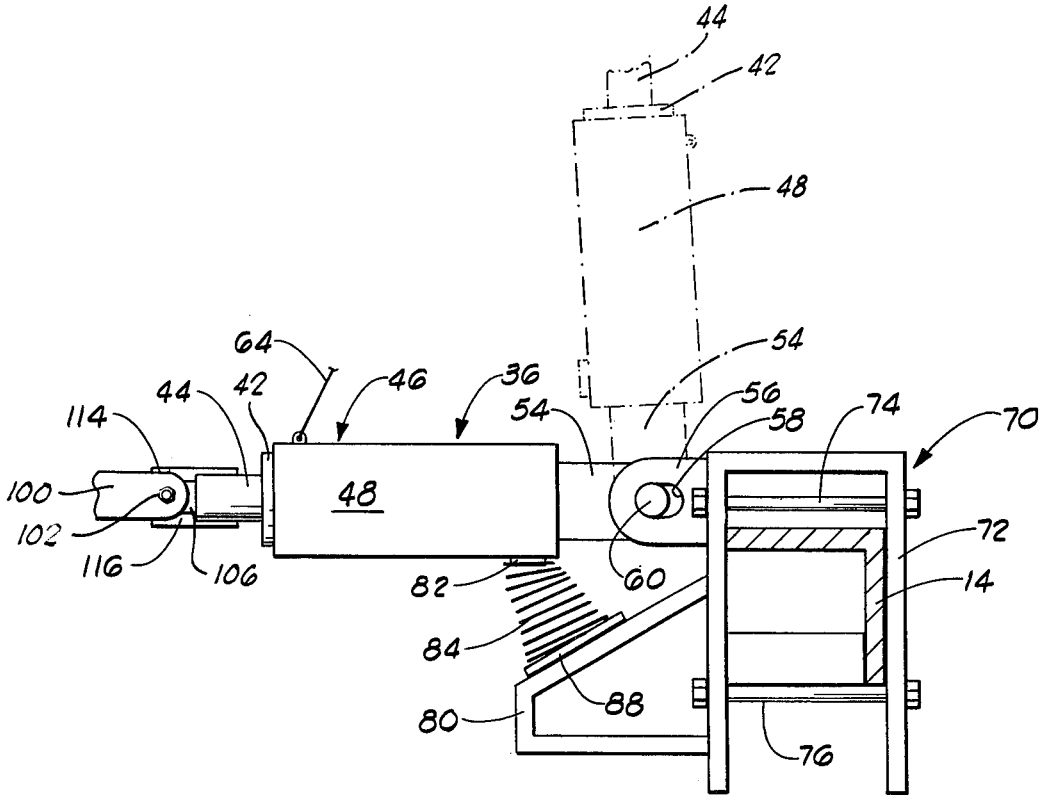
FIG. 3 is a sectional view taken along line 3—3 of FIG. 2.

The piston and cylinder subassemblies 34 and 36 are illustrated in greater detail in FIGS. 2–4. As there shown, each of these subassemblies includes a cylinder 42 and a piston rod 44 which projects from the cylinder and is joined at an internal end to a piston (not shown) reciprocably mounted in the cylinder in accordance with conventional construction. The piston and cylinder subassemblies 34 and 36 are preferably hydraulically actuated, but may also be pneumatically actuated if desired.

Each of the piston and cylinder subassemblies 34 and 36 is supported within a mounting frame 46 which includes vertically extending side frame plates 48 which are welded at their lower edges to a first horizontally extending frame plate 50 and at their top edges to a second horizontally extending frame plate 51. The frame plates 48, 50 and 51 are joined by a mounting block 52 interconnected between them at the ends of the frame plates. A knuckle plate 54 is welded or otherwise suitably secured to the mounting block 52 and projects rearwardly therefrom into a bifurcated pivot bracket 56 which has an elongated slot 58 formed therethrough, which slot is positioned in alignment with an aperture formed through the knuckle plate 54. A pivot pin 60 is projected through the slot 58 and the aperture in the knuckle plate 54 to establish a pivotal connection between the mounting frame 46 carrying the respective piston and cylinder subassemblies 34 and 36 and the bifurcated bracket 56.

The cylinders 42 of the respective subassemblies 34 and 36 are movably mounted within the respective mounting frames in which they are located so that each cylinder can move toward and away from the mounting block 52 to some limited degree. A spring 62 is interconnected between the mounting block 52 and the rear end of the respective cylinder 42 for the purpose of damping or cushioning oscillating movements of the casing section engaged by the casing stabbing system of the invention in a manner hereinafter described. Each spring 62 is positioned and dimensioned so that it can function either in compression or in tension.

In order to facilitate the movement of each of the piston and cylinder subassemblies 34 and 36 between a substantially horizontally extending operative position and a vertically extending inoperative position, a flexible cable or wire rope 64 is connected at one of its ends to the forward end of one of the respective mounting frames 46, and is extended upwardly and over a suitable sheave or pulley 66 mounted on one of the cross braces 14 of the derrick or mast 12 above the location of the platform 40. At its end opposite the end connected to the respective mounting frame 46, the flexible member or wire rope 64 carries a counterweight 68 which counterbalances a substantial part of the total weight of the respective piston and cylinder subassembly when it is extended horizontally in its operative position as shown in FIG. 1. When the piston and cylinder subassemblies are to be moved to an inoperative position at a time during the stabbing operation as hereinafter explained, the crewman 38 can swing each subassembly upwardly with minimal effort due to the counterbalancing effect of the counterbalance weight 68 connected to each of the subassemblies in the manner described.

In order to facilitate the described pivotal movement of each of the piston and cylinder subassemblies between an operative and inoperative position, the bifurcated pivot bracket 56 is welded or otherwise suitably secured to a mounting bracket subassembly, designated generally by reference numeral 70. The mounting bracket subassembly 70, employed in the case of each of the piston and cylinder subassemblies for securing it to the mast 12 in the manner illustrated in FIGS. 1 and 3, includes a U-shaped structural element 72 which is dimensioned to pass over and engage one of the angle iron cross braces 14 of the mast 12. A pair of tensioning bolts 74 and 76 are then extended through holes formed through the legs of the U-shaped element 72, and nuts are tightened on the tensioning bolts to tightly secure the mounting bracket subassembly 70 on the cross brace. As illustrated in FIG. 1, the piston and cylinder subassemblies 34 and 36 are mounted on cross braces 14 located at adjacent sides of the mast 12 so that the piston and cylinder subassemblies extend substantially at a right angle to each other when they are in their operative positions as shown in FIG. 1.

To aid in controlling and limiting the movement of the piston and cylinder subassemblies and assure that they do not pivot downwardly past the operative position in which they are used for controlling the movement of a casing section, a spring support plate 80 of trapezoidal configuration is welded to the inner side of each mounting bracket subassembly 70 at a location directly beneath the respective knuckle plate 54 and the respective rear end of the mounting frame 46. The horizontally extending frame plate 50 of each of the mounting frames 46 carries a downwardly projecting protuberant spring stud 82 which serves as a securement point for maintaining the upper end of a compression spring 84 in a positon of contact with the rear end of the mounting frame 46. The compression spring 84 is anchored in a spring retention pad 88 secured to one leg of the spring support plate 80.

At the inner end of the piston and cylinder subassembly 36, the piston rod 44 is connected to a casing clamping collar or clamp subassembly designated generally by reference numeral 90. The clamp subassembly 90 includes a pair of cooperating clamp jaws 92 and 94 which are interconnected by hinge 96 to permit the clamp jaw 94 to be pivoted to an open position as shown in dashed lines in FIG. 2. When the clamp subassembly is clamped about a casing section, such as the casing section 30 illustrated in FIG. 2, a pin latch 98 is used for interlocking the two clamp sections 92 and 94 to each other in a closed position in which the clamp subassembly encircles the casing section. The diameter of the closed clamp subassembly 90 is such that the casing section is not tightly engaged, yet is sufficiently closely surrounded that the casing section cannot undergo significant movement within the clamp subassembly.

Figure 5:
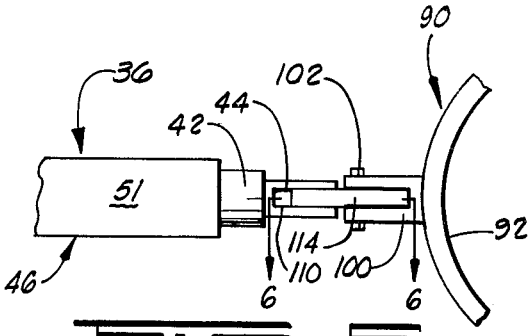
FIG. 5 is a detailed view, in plan, of the connection between a part of the clamp subassembly and the piston rod of one of the piston and cylinder subassemblies.
Figure 6:
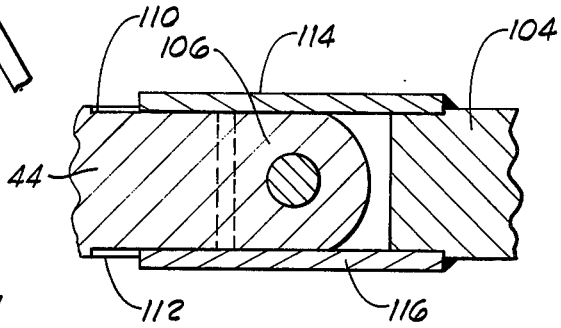
FIG. 6 is a sectional view taken along line 6—6 of FIG. 5.

A bifurcated bracket 100 is welded or otherwise suitably secured to the clamp jaw 92. The bracket 100 is pivotally connected by means of a pivot pin 102 to a tongue 106 which projects from the end of the piston rod 44 into the bifurcation in the bracket 100 in the manner illustrated in FIGS. 5 and 6. Grooves 110 and 112 are formed on the upper and lower sides of the piston rod 44 and accommodate the free ends of a pair of leaf springs 114 and 116. The opposite ends of the leaf springs 114 and 116 are welded to the opposite sides of the bracket 100 as shown in FIG. 6. The purpose of this construction of the connecting linkage between the clamp jaw 92 and the piston rod 44 will be hereinafter explained.

In order to engage the clamp subassembly 90 to the piston rod 44 carried on the piston and cylinder subassembly 34, an elongated hook element 118 is secured to the free end of the piston rod 44 and is dimensioned to be hooked into and engaged with an apertured eye 120 secured to the clamp jaw 94 as illustrated in FIGS. 2 and 4.

OPERATION

In utilizing the casing stabbing system of the invention, a series of casing sections are connected in end-to-end relationship to form a casing string by joinder of threaded end portions at the ends of each section of casing. In order to accomplish this, the casing string, as it is developed, is lowered into the well bore to be cased, with each new section which is added to the string being screwed into the uppermost casing section of the string being lowered into the well bore. For this purpose, the casing string is suspended in the well bore from the rotary table 20 located on the rig floor 18 of the drilling rig 10. Suspension of the casing string is accomplished in a manner well understood in the art by the use of slips with which the top section of casing is wedged into an opening through the rotary table.

In explaining the operation of the casing stabbing system of the present invention, it will be assumed that a casing string has been suspended in the well bore in the manner described, and that the uppermost section of casing in the string, denominated by reference numeral 30 in the drawings, has been wedged in the suspended position in the rotary table 20 by the use of suitable slips (not illustrated).

At this time, in order to threadedly join the next casing section to the upper end of the casing section 30, a length of casing is picked up by the conventional tackle provided on the rig, and is suspended on the hook 28 connected through a swivel to a crown block 26 provided at the top of the mast 12. This casing section, denominated by reference numeral 30 in the drawings, hangs from the crown block down through the mast 12 of the drilling rig, and normally oscillates as it hangs from the crown block. It has previously been the practice to provide a crewman standing on the platform 40 located between the top of the mast 12 and the rig floor 18 to damp the oscillations of the casing section 30 and eventually bring it to a sufficiently stationary status that crewmen standing on the rig floor 18 can then make the final adjustment and movement of the threaded lower end of the casing section until it is aligned directly above the internally threaded upper end or box 24 of the suspended casing section 22.

In utilizing the present invention, after the casing section 30 has been picked up and suspended from the crown block 26, a crewman standing on the platform 40 first slows the oscillations of the casing section sufficiently that he can then pull down from a vertically extending to a horizontally extending position, the piston and cylinder subassemblies 34 and 36. This movement of these subassemblies is rendered less difficult by the counter-balancing system provided and constituted by the flexible cable or wire rope 64, the pulley 66 and the counterweight 68 associated with each piston and cylinder subassembly.

After the piston and cylinder subassemblies 34 and 36 are placed in their horizontally extending position, so that they extend generally toward the casing section 30, the piston and cylinder subassembly 36 is actuated to extend the piston rod 44. This extension is commenced at a time after the clamp subassembly 90 has been manipulated to open the clamp jaw 94 apart from the clamp jaw 92. With the extension of the piston rod 44 in this fashion, the clamp jaw 94 is then brought into contact with one side of the casing section 30. The crewman 38 on the platform 40 then swings the clamp jaw 94 to its closed position about the casing section 30 and locks it in this closed position by the use of the pin latch 98.

Next, the crewmen 38, with the aid of the adjustability provided by the piston and cylinder subassembly 34 connected to the casing section 30 slightly adjusts the position of the casing until the elongated hook element 118 secured to the free end of the piston rod 44 forming a part of the piston and cylinder subassembly 34 can be inserted through the eye 120 secured to the clamp jaw 94. At this time, both of the piston and cylinder subassemblies 34 and 36 are connected to the casing section 22 through the clamp subassembly 90 now securely placed around the casing.

As previously pointed out, the clamp jaws 92 and 94 of the clamp subassembly 90 do not tightly engage the casing so that it is hindered from undergoing rotation. They do fit sufficiently closely about the casing section 30, however, that the casing is not free to swing or oscillate within the clamp subassembly to any significant degree.

As the crew lowers away on the casing section 30 which is suspended from the crown block 26, the crewman 38 on the platform 40 continually adjust the position of the casing so as to guide and direct the threaded lower end thereof to a position immediately above the threaded upper end or box 24 of the suspended lower casing section 22. During this time, any tendency of the casing section 30 to undergo lateral movement as a result of rotation of the crown block or spin of the hook 28, should the casing section be deviated from axial linearity, can be accommodated by the spring elements 62 which can function either in compression or in tension. In effect, the spring elements function to dampen, without preventing any lateral movement of the casing section 30 in the plane of the two piston and cylinder subassemblies 34 and 36 without allowing the full impact of such lateral movement to be absorbed by the piston rods 44, or by the cylinders 32 in which the rods move. The same tendency towards lateral movement of the casing section within the plane of the piston and cylinder subassemblies may tend to occur as the threaded lower end of the casing section 30 is first placed in contact with the threaded box or collar 24 on the upper end of the casing section 22, and the threading operation is commenced by the use of power tongs 120 utilized by crewmen on the rig floor 18.

Adjustments can be continually made in the position of the casing section 30 by the use of the hydraulic piston and cylinder subassemblies 34 and 36. In this regard, it will be noted that the bi-directional reciprocations of the two piston rods 44 of the two subassemblies 34 and 36 can be further accommodated by the mounting of the knuckle plates 54 upon the pivot pins 60 which can undergo some canting movement in the elongated slots 58 provided in the respective bifurcated pivot brackets 56.

It will also be noted that in those instances where there is sufficient frictional engagement between the casing section 30 to cause the clamp subassembly to be carried downwardly with the casing section 30 as it is screwed into the suspended casing section 22 therebelow, articulation provided between the piston rod 44 of the subassembly 36 and the bracket 100 will permit accommodation of this movement. Sufficient rigidity is, however, provided in this linkage between the piston rod 44 and the bracket 100 to assure the linear direction of the force developed by the extending piston rod directly to the clamp jaw 92. This rigidity is provided by means of the pair of leaf springs 114 and 116 which resiliently urge the piston rod 44 into alignment with the bracket 100, except when a bending moment in excess of the bias exerted by these springs is brought to bear on the linkage. This occasionally occurs when the clamp subassembly 90 tends to follow the casing downwardly during the last increment of downward movement as the casing section 30 is screwed up to the tightened position to make up the joint with the next lower casing section 22.

After threading of the casing section 30 into the casing section 22 has been commenced by the use of the power tongs, the crewman 38 can commence to detach the casing stabbing system from the upper casing section in preparation for placing the piston and cylinder subassemblies 34 and 36 in their inoperative position while waiting for a new casing section to be picked up by the tackle and suspended from the crown block 26. In detaching the stabbing system from the casing section 30, the crewman will first detach the hook element 118 from the apertured eye 120. Next, the pin latch 98 is unlatched so that the clamp jaws 92 and 94 can be opened apart from each other about the hinge 96. Opening of the clamp jaws 92 and 94 apart so as to detach the clamp subassembly 90 from the casing section 22 is accomplished (after the pin latch has been unlatched) by retracting the piston rod 44 of the piston and cylinder subassembly 34. After the clamp subassembly is opened, further retraction of the piston rods 44 of the piston and cylinder subassemblies 34 and 36 withdraws these subassemblies from the casing section and they are now ready to be pivoted upwardly to their vertically extending, inoperative position. A slight push by the crewman 38 can affect this result due to the counterbalancing affect of the counterweights 68. The casing stabbing system is now ready for repetition of the process described.

Although a preferred embodiment of the present invention has been herein described in order to enable its practice by those skilled in the art, and to exemplify the fundamental principles which underlie the invention, various changes and modifications can be effected in the described preferred embodiment without departure from the basic principles which underlie the invention. Changes and innovations of this type are therefore deemed to be circumscribed by the spirit and scope of the invention, except as the same may be necessarily limited by the appended claims, or reasonable equivalents thereof.

What is claimed is:

1. A system for stabbing well casing comprising:

a drilling rig mast;

a first piston and cylinder subassembly pivotally connected to the mast for pivotation about a horizontal axis between a vertically extending, inoperative position and a horizontally extending, operative position;

a clamp subassembly connected to said first piston and cylinder subassembly and including a pair of hingedly interconnected clamp jaws adapted for clampingly engaging a section of casing;

a second piston and cylinder subassembly pivotally connected to the mast for pivotation about a horizontal axis between a vertically extending, inoperative position and a horizontally extending, operative position, said second piston and cylinder subassembly extending at a right angle to said first piston and cylinder subassembly when said piston and cylinder subassemblies are pivoted to their operative, horizontally extending positions;

means connected to said second piston and cylinder subassembly for quick detachably engaging said clamp subassembly when said clamp subassembly is clampingly engaged with a casing section; and means associated with each of said piston and cylinder subassemblies for resiliently damping lateral movement of a casing section engaged by said clamp subassembly.

2. A system as defined in claim 1 and further characterized as including counterbalancing means connected to each of said piston and cylinder subassemblies and exerting a force thereupon tending to move the respective piston and cylinder subassemblies from a horizontally extending operative position to a vertically extending inoperative position.

3. A system as defined in claim 1 and further characterized as including spring means associated with each of said piston and cylinder subassemblies for resiliently supporting each of said subassemblies in a horizontally extending position while yet facilitating resiliently opposed pivotation downwardly of each of said piston and cylinder subassemblies from a horizontally extending position.

4. A system as defined in claim 1 and further characterized as including an articulated connection between said first piston and cylinder subassembly and said clamp subassembly, said articulated connection comprising:

a bifurcated bracket secured to the clamp subassembly;

a tongue connected to and projecting from the first piston and cylinder subassembly;

a pivot pin pivotally interconnecting said tongue with said bifurcated bracket; and leaf spring means operatively connected between said bifurcated bracket and tongue and resiliently biasing said tongue into alignment with said bracket without preventing pivotation of said tongue relative to said bracket.

5. A system as defined in claim 1 and further characterized as including:

a mounting frame supporting each of said piston and cylinder subassemblies;

a pair of mounting bracket subassemblies, each of said mounting bracket subassemblies connected to said mast;

a bifurcated pivot bracket connected to each of said mounting bracket subassemblies; and knuckle plates connected to each of said mounting frames and each pivotally connected to one of said pivot brackets for pivotation about a horizontal axis of pivotation.

6. A system as defined in claim 5 wherein each of said pivot brackets defines a pair of horizontally extending slots; and wherein said system further includes a pivot pin extending through said horizontally extending slots in each of said pivot brackets and through the respective knuckle plate pivotally connected thereto whereby each of the piston and cylinder subassemblies can swing from side to side in a horizontal plane as said pivot pin moves in said slots.

7. A system as defined in claim 5 wherein said means for damping lateral movement of a casing section engaged by said clamp subassembly comprises a spring connected between said mounting frame and the respective piston and cylinder subassembly supported thereby and facilitating resiliently damped movement of the respective piston and cylinder subassembly in the respective mounting frame in which it is supported.

8. A system as defined in claim 2 wherein said counterbalancing means includes a pair of pulleys connected to said mast and located on opposite sides thereof at a location spaced vertically above said piston and cylinder subassemblies;

a flexible element connected to each of said piston and cylinder subassemblies and extended upwardly therefrom and over one of said pulleys; and a weight secured to the opposite end of each of said flexible members from its end connected to one of the piston and cylinder subassemblies.

9. A system as defined in claim 2 and further characterized as including spring means associated with each of said piston and cylinder subassemblies for resiliently supporting each of said subassemblies in a horizontally extending position while yet facilitating resiliently opposed pivotation downwardly of each of said piston and cylinder subassemblies from a horizontally extending position.

10. A system as defined in claim 2 and further characterized as including an articulated connection between said first piston and cylinder subassembly and said clamp subassembly, said articulated connection comprising:

a bifurcated bracket secured to the clamp subassembly;

a tongue connected to and projecting from the first piston and cylinder subassembly;

a pivot pin pivotally interconnecting said tongue with said bifurcated bracket; and leaf spring means operatively connected between said bifurcated bracket and tongue and resiliently biasing said tongue into alignment with said bracket without preventing pivotation of said tongue relative to said bracket.

11. A system as defined in claim 2 and further characterized as including:

spring means associated with each of said piston and cylinder subassemblies for resiliently supporting each of said subassemblies in a horizontally extending position while yet facilitating resiliently opposed pivotation downwardly of each of said piston and cylinder subassemblies from a horizontally extending position;

an articulated connection between said first piston and cylinder subassembly and said clamp subassembly, said articulated connection comprising:

a bifurcated bracket secured to the clamp subassembly;

a tongue connected to and projecting from the first piston and cylinder subassembly;

a pivot pin pivotally interconnecting said tongue with said bifurcated bracket; and leaf spring means operatively connected between said bifurcated bracket and tongue and resiliently biasing said tongue into alignment with said bracket without preventing pivotation of said tongue relative to said bracket.

12. A system as defined in claim 1 and further characterized as including:

counterbalancing means connected to each of said piston and cylinder subassemblies and exerting a force thereupon tending to move the respective piston and cylinder subassemblies from a horizontally extending operative position to a vertically extending inoperative position;

a mounting frame supporting each of said piston and cylinder subassemblies;

a pair of mounting bracket subassemblies, each of said mounting bracket subassemblies connected to said mast;

a bifurcated pivot bracket connected to each of said mounting bracket subassemblies; and knuckle plates connected to each of said mounting frames and each pivotally connected to one of said pivot brackets for pivotation about a horizontal axis of pivotation.

13. A system for stabbing well casing comprising:

a drilling rig mast;

a first piston and cylinder subassembly pivotally connected to said mast for pivotation about a horizontal axis between a vertically extending, inoperative position, and a horizontally extending, operative position, said first piston and cylinder subassembly including a cylinder, a piston mounted in the cylinder, and a piston rod projecting from the cylinder and connected to the piston;

a clamp subassembly connected to the outer end of the piston rod of said first piston and cylinder subassembly, and including:

a pair of hingedly interconnected, semicylindrical clamp jaws adapted for clampingly engaging a section of casing;

latch means for latching said clamp jaws in a closed cylindrical configuration about a casing section, said jaws defining an inner diameter larger than the outer diameter of the casing section to be clamped by the clamp subassembly whereby a casing section may be both axially lowered and rotated within said clamp subassembly without imparting a corresponding movement to said clamp subassembly;

an apertured connection element secured to one of said clamp jaws;

a second piston and cylinder subassembly pivotally connected to the mast for pivotation about a horizontal axis between a vertically extending, inoperative position and a horizontally extending, operative position, said second piston and cylinder subassembly including a cylinder, a piston within the cylinder and a piston rod connected to the piston and extending from the cylinder and;

a curved hook secured to the outer end of the piston rod of said second piston and cylinder subassembly, and dimensioned and configured to pass through and engage said apertured element, and to be quickly detachable from said apertured element.

* * * * *